US008971782B2

(12) United States Patent
Saito et al.

(10) Patent No.: US 8,971,782 B2
(45) Date of Patent: Mar. 3, 2015

(54) FIXING DEVICE, IMAGE FORMING APPARATUS INCORPORATING SAME, AND METHOD FOR HEATING FIXING ROTARY BODY

(75) Inventors: Kazuya Saito, Kanagawa (JP); Masanao Ehara, Kanagawa (JP); Tadashi Ogawa, Tokyo (JP); Takeshi Uchitani, Kanagawa (JP); Satoshi Ueno, Tokyo (JP); Teppei Kawata, Kanagawa (JP); Takamasa Hase, Tokyo (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/337,617

(22) Filed: Dec. 27, 2011

(65) Prior Publication Data

US 2012/0177424 A1 Jul. 12, 2012

(30) Foreign Application Priority Data

Jan. 11, 2011 (JP) ..... 2011-002892

(51) Int. Cl.
*G03G 15/20* (2006.01)
*H05B 6/14* (2006.01)

(52) U.S. Cl.
CPC ..... *G03G 15/2053* (2013.01); *G03G 15/2078* (2013.01); *G03G 15/2007* (2013.01); *H05B 6/145* (2013.01); *G03G 15/2082* (2013.01)
USPC ..... 399/334

(58) Field of Classification Search
CPC ..... G03G 15/20
USPC ..... 399/69, 320, 328, 330, 331, 334, 336, 399/338
See application file for complete search history.

(56) References Cited

U.S. PATENT DOCUMENTS

| | | | | |
|---|---|---|---|---|
| 7,266,336 | B2 | 9/2007 | Ueno et al. | |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 * | 9/2010 | Seo et al. | 399/69 |
| 7,817,952 | B2 | 10/2010 | Seo et al. | |
| 7,885,590 | B2 | 2/2011 | Seo et al. | |
| 7,925,177 | B2 | 4/2011 | Ishii et al. | |

(Continued)

FOREIGN PATENT DOCUMENTS

JP 2008185991 A 8/2008

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A fixing device includes an induction heater constructed of an exciting coil, a first pair of degaussing coils, and a second pair of degaussing coils. A controller turns off the exciting coil while the controller turns on one of the first pair of degaussing coils and the second pair of degaussing coils and at the same time turns off the other one of the first pair of degaussing coils and the second pair of degaussing coils, and then turns on the exciting coil for an extra time period corresponding to reserved power not supplied to the exciting coil while the exciting coil is turned off.

8 Claims, 5 Drawing Sheets

(56) References Cited

U.S. PATENT DOCUMENTS

| | | | | |
|---|---|---|---|---|
| 7,983,582 | B2 | 7/2011 | Hase | |
| 8,014,711 | B2 | 9/2011 | Ito et al. | |
| 8,175,480 | B2 * | 5/2012 | Seo et al. | 399/67 |
| 2005/0191098 | A1 | 9/2005 | Ueno et al. | |
| 2006/0029411 | A1 | 2/2006 | Ishii et al. | |
| 2006/0165443 | A1 | 7/2006 | Yoshinaga et al. | |
| 2006/0289419 | A1 | 12/2006 | Ueno | |
| 2007/0014600 | A1 | 1/2007 | Ishii et al. | |
| 2007/0059011 | A1 | 3/2007 | Seo et al. | |
| 2007/0201916 | A1 | 8/2007 | Ueno | |
| 2007/0212089 | A1 | 9/2007 | Seo et al. | |
| 2007/0264060 | A1 | 11/2007 | Ueno et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0044196 | A1 | 2/2008 | Seo et al. | |
| 2008/0063443 | A1 | 3/2008 | Yoshinaga et al. | |
| 2008/0219721 | A1 | 9/2008 | Ito et al. | |
| 2008/0226326 | A1 * | 9/2008 | Seo et al. | 399/69 |
| 2008/0232873 | A1 | 9/2008 | Ueno et al. | |
| 2008/0317532 | A1 | 12/2008 | Ehara et al. | |
| 2009/0060550 | A1 * | 3/2009 | Seo | 399/69 |
| 2009/0123201 | A1 | 5/2009 | Ehara et al. | |
| 2009/0148205 | A1 * | 6/2009 | Seo et al. | 399/330 |
| 2009/0245897 | A1 | 10/2009 | Seo et al. | |
| 2009/0297197 | A1 | 12/2009 | Hase | |
| 2010/0014903 | A1 | 1/2010 | Seto et al. | |
| 2010/0061753 | A1 * | 3/2010 | Hase | 399/69 |
| 2010/0074667 | A1 | 3/2010 | Ehara et al. | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0176822 | A1 | 7/2011 | Ishii et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |

* cited by examiner

FIXING DEVICE, IMAGE FORMING APPARATUS INCORPORATING SAME, AND METHOD FOR HEATING FIXING ROTARY BODY

CROSS-REFERENCE TO RELATED APPLICATIONS

This patent application is based on and claims priority pursuant to 35 U.S.C. §119 to Japanese Patent Application No. 2011-002892, filed on Jan. 11, 2011, in the Japanese Patent Office, the entire disclosure of which is hereby incorporated herein by reference.

FIELD OF THE INVENTION

Example embodiments generally relate to a fixing device, an image forming apparatus, and a method for heating a fixing rotary body, and more particularly, to a fixing device for fixing a toner image on a recording medium, an image forming apparatus including the fixing device, and a method used by the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image foaming apparatuses may employ an induction heater to warm up the fixing device quickly to a predetermined fixing temperature with reduced energy consumption. For example, the induction heater is disposed opposite a fixing roller that presses against a pressing roller to form a fixing nip between the fixing roller and the pressing roller. As a recording medium bearing a toner image passes through the fixing nip, the fixing roller heated by the induction heater and the pressing roller apply heat and pressure to the recording medium, thus melting and fixing the toner image on the recording medium.

Specifically, the induction heater includes an exciting coil that generates a magnetic flux toward a conductive layer of the fixing roller. As the magnetic flux reaches the conductive layer of the fixing roller, the conductive layer generates an eddy current that heats the conductive layer throughout the entire width of the fixing roller in the axial direction thereof. However, if a small recording medium having a width smaller than the entire width of the fixing roller in the axial direction thereof is conveyed through the fixing nip, the lateral ends of the fixing roller in the axial direction thereof over which the small recording medium is not conveyed may be overheated because the small recording medium does not draw heat from the lateral ends of the fixing roller in the axial direction thereof To address this circumstance, degaussing coils may be disposed between the exciting coil and the fixing roller in such a manner that the degaussing coils are disposed opposite the lateral ends of the fixing roller in the axial direction thereof, respectively, to offset the magnetic flux generated by the exciting coil toward the fixing roller, thus minimizing the magnetic flux that reaches the conductive layer of the fixing roller and therefore preventing overheating of the lateral ends of the fixing roller in the axial direction thereof For example, when the image forming apparatus receives a print job for forming a toner image on a small recording medium, the degaussing coils are turned on. Conversely, when the image forming apparatus receives a print job for forming a toner image on a large recording medium, the degaussing coils are turned off.

However, such configuration has a drawback in that the degaussing coils cannot be turned on and off while the exciting coil is turned on because serially-connected relays used to turn on and off the degaussing coils may be short-circuited and melted. To address this circumstance, it is necessary to turn off the exciting coil temporarily while the degaussing coils are turned on and off, generating variation in the temperature of the fixing roller in the direction of rotation of the fixing roller. Specifically, since the fixing roller rotates even while the exciting coil is turned off temporarily, a section of the fixing roller that passes through the induction heater while the exciting coil is turned off is not heated by the induction heater. Accordingly, the fixing roller has a heated section heated by the induction heater and a non-heated section not heated by the induction heater, resulting in temperature variation of the fixing roller in the direction of rotation of the fixing roller. Consequently, the fixing roller heats the toner image on the recording medium unevenly, thus forming a faulty toner image on the recording medium.

SUMMARY OF THE INVENTION

At least one embodiment may provide a fixing device that includes a fixing rotary body rotatable in a predetermined direction of rotation; an induction heater disposed opposite the fixing rotary body to heat the fixing rotary body; and a controller operatively connected to the induction heater. The induction heater includes an exciting coil to generate a magnetic flux toward the fixing rotary body; a first pair of degaussing coils disposed opposite lateral ends of the exciting coil in an axial direction of the fixing rotary body to offset the magnetic flux generated by the exciting coil, each degaussing coil of the first pair having a first width in the axial direction of the fixing rotary body; a second pair of degaussing coils disposed opposite the lateral ends of the exciting coil in the axial direction of the fixing rotary body to offset the magnetic flux generated by the exciting coil, each degaussing coil of the second pair having a second width in the axial direction of the fixing rotary body greater than the first width of each degaussing coil of the first pair; an exciting coil switch connected to the exciting coil and a power supply to connect and disconnect the exciting coil to and from the power supply to turn on and off the exciting coil; a first degaussing coil switch connected to the first pair of degaussing coils to turn on and off the first pair of degaussing coils; and a second degaussing coil switch connected to the second pair of degaussing coils to turn on and off the second pair of degaussing coils. The controller causes the exciting coil switch to turn off the exciting coil while the controller turns on one of the first degaussing coil switch and the second degaussing coil switch and at the same time turns off the other one of the first degaussing coil switch and the second degaussing coil switch, and then causes the exciting coil switch to turn on the exciting coil for an extra time period corresponding to reserved power not supplied to the exciting coil while the exciting coil is turned off.

At least one embodiment may provide a fixing device that includes a fixing rotary body rotatable in a predetermined direction of rotation; an induction heater disposed opposite the fixing rotary body to heat the fixing rotary body; and a controller operatively connected to the induction heater. The induction heater includes an exciting coil to generate a magnetic flux toward the fixing rotary body; a first degaussing coil disposed opposite one lateral end of the exciting coil in an axial direction of the fixing rotary body to offset the magnetic flux generated by the exciting coil and having a width in the axial direction of the fixing rotary body; a second degaussing coil disposed opposite the one lateral end of the exciting coil in the axial direction of the fixing rotary body to offset the magnetic flux generated by the exciting coil and having a width in the axial direction of the fixing rotary body greater than the width of the first degaussing coil; an exciting coil switch connected to the exciting coil and a power supply to connect and disconnect the exciting coil to and from the power supply to turn on and off the exciting coil; a first degaussing coil switch connected to the first degaussing coil to turn on and off the first degaussing coil; and a second degaussing coil switch connected to the second degaussing coil to turn on and off the second degaussing coil. The controller causes the exciting coil switch to turn off the exciting coil while the controller turns on one of the first degaussing coil switch and the second degaussing coil switch and at the same time turns off the other one of the first degaussing coil switch and the second degaussing coil switch, and then causes the exciting coil switch to turn on the exciting coil for an extra time period corresponding to reserved power not supplied to the exciting coil while the exciting coil is turned off.

At least one embodiment may provide an image fanning apparatus that includes the fixing device described above.

At least one embodiment may provide a method for heating a fixing rotary body with an induction heater including an exciting coil and a plurality of degaussing coils. The method includes steps of rotating the fixing rotary body; turning on the exciting coil; identifying a size of a recording medium to be conveyed to the fixing rotary body; turning off the exciting coil; turning on one of the plurality of degaussing coils and turning off the other one of the plurality of degaussing coils according to the identified size of the recording medium; turning on the exciting coil; and supplying reserved power not supplied to the exciting coil while the exciting coil is turned off to the exciting coil to turn on the exciting coil for an extra time period corresponding to the supplied power.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
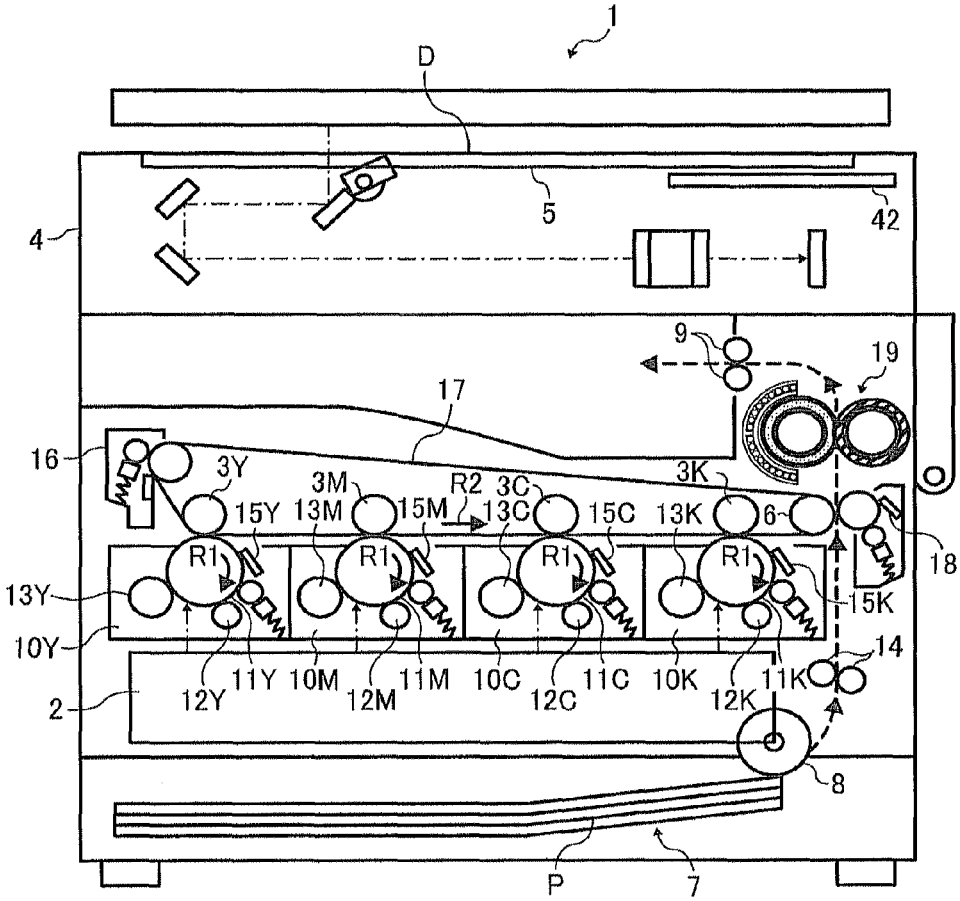
FIG. 1 is a schematic sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an example embodiment of the present invention is explained.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a tandem color copier for forming a color image on a recording medium by electrophotography.

Referring to FIG. 1, the following describes the structure of the image forming apparatus 1.

As illustrated in FIG. 1, the image forming apparatus 1 includes four image forming devices 10Y, 10M, 10C, and 10K disposed in a center portion of the image forming apparatus 1 and aligned in a horizontal direction. The image forming devices 10Y, 10M, 10C, and 10K that form yellow, magenta, cyan, and black toner images include drum-shaped photoconductors 11Y, 11M, 11C, and 11K surrounded by chargers 12Y, 12M, 12C, and 12K, development devices 13Y, 13M, 13C, and 13K, and cleaners 15Y, 15M, 15C, and 15K, respectively. Yellow, magenta, cyan, and black toner bottles disposed in an upper portion of the image forming apparatus 1 supply yellow, magenta, cyan, and black toners in a predetermined amount to the development devices 13Y, 13M, 13C, and 13K through toner supply tubes, respectively.

Above the image forming devices 10Y, 10M, 10C, and 10K in the upper portion of the image forming apparatus 1 is a reader 4 that reads an image on an original document D placed on an exposure glass 5 disposed atop the image forming apparatus 1. Specifically, the reader 4 includes a light source, a polygon mirror, an f theta lens, and reflection mirrors to read the image on the original document D into yellow, magenta, cyan, and black image data. Below the image forming devices 10Y, 10M, 10C, and 10K is an optical writer 2 electrically connected to the reader 4. The optical writer 2 emits laser beams onto an outer circumferential surface of the respective photoconductors 11Y, 11M, 11C, and 11K charged by the chargers 12Y, 12M, 12C, and 12K according to the yellow, magenta, cyan, and black image data sent from the reader 4 in such a manner that the laser beams scan the charged outer circumferential surface of the photoconductors 11Y, 11M, 11C, and 11K, respectively, as the photoconductors 11Y, 11M, 11C, and 11K rotate clockwise in FIG. 1 in a rotation direction R1. Thus, an electrostatic latent image is formed on the outer circumferential surface of the respective photoconductors 11Y, 11M, 11C, and 11K. The development devices 13Y, 13M, 13C, and 13K supply the yellow, magenta, cyan, and black toners to the photoconductors 11Y, 11M, 11C, and 11K to render the electrostatic latent images formed thereon visible as yellow, magenta, cyan, and black toner images, respectively.

Above the image forming devices 10Y, 10M, 10C, and 10K is an endless intermediate transfer belt 17 looped over a plurality of support rollers including a driving roller that drives and rotates the intermediate transfer belt 17. For example, a driver (e.g., a motor) is connected to a rotation shaft of the driving roller. As the driver drives the driving roller, the driving roller rotates the intermediate transfer belt 17 counterclockwise in FIG. 1 in a rotation direction R2 in a state in which the rotating intermediate transfer belt 17 rotates the plurality of support rollers over which the intermediate transfer belt 17 is looped.

Primary transfer rollers 3Y, 3M, 3C, and 3K disposed inside a loop formed by the intermediate transfer belt 17 transfer the yellow, magenta, cyan, and black toner images formed on the photoconductors 11Y, 11M, 11C, and 11K onto an outer circumferential surface of the intermediate transfer belt 17 in such a manner that the yellow, magenta, cyan, and black toner images are superimposed on the same position on the intermediate transfer belt 17, thus forming a color toner image on the intermediate transfer belt 17. After the transfer of the yellow, magenta, cyan, and black toner images, the cleaners 15Y, 15M, 15C, and 15K remove residual toner not transferred onto the intermediate transfer belt 17 and therefore remaining on the photoconductors 11Y, 11M, 11C, and 11K therefrom.

Downstream from the primary transfer rollers 3Y, 3M, 3C, and 3K in the rotation direction R2 of the intermediate transfer belt 17 is a secondary transfer roller 6. A secondary transfer opposed roller 18 is disposed opposite the secondary transfer roller 6 via the intermediate transfer belt 17 in such a manner that the secondary transfer opposed roller 18 presses against the secondary transfer roller 6 via the intermediate transfer belt 17.

A paper tray 7 disposed in a bottom portion of the image forming apparatus 1 loads a plurality of recording media P (e.g., sheets). Above the paper tray 7 is a feed roller 8 that picks up and feeds an uppermost recording medium P from the paper tray 7 to a registration roller pair 14. The registration roller pair 14 feeds the recording medium P to a secondary transfer nip formed between the secondary transfer opposed roller 18 and the intermediate transfer belt 17 at a time when the secondary transfer roller 6 transfers the color toner image formed on the intermediate transfer belt 17 onto the recording medium P. After the transfer of the color toner image onto the recording medium P, a belt cleaner 16 disposed opposite the intermediate transfer belt 17 removes residual toner not transferred onto the recording medium P and therefore remaining on the intermediate transfer belt 17 therefrom.

Downstream from the secondary transfer nip in a conveyance direction of the recording medium P is a fixing device 19 that fixes the color toner image on the recording medium P and conveys the recording medium P bearing the fixed toner image to an output roller pair 9 disposed downstream from the fixing device 19 in the conveyance direction of the recording medium P. The output roller pair 9 discharges the recording medium P onto an outside of the image forming apparatus 1.

Figure 2:
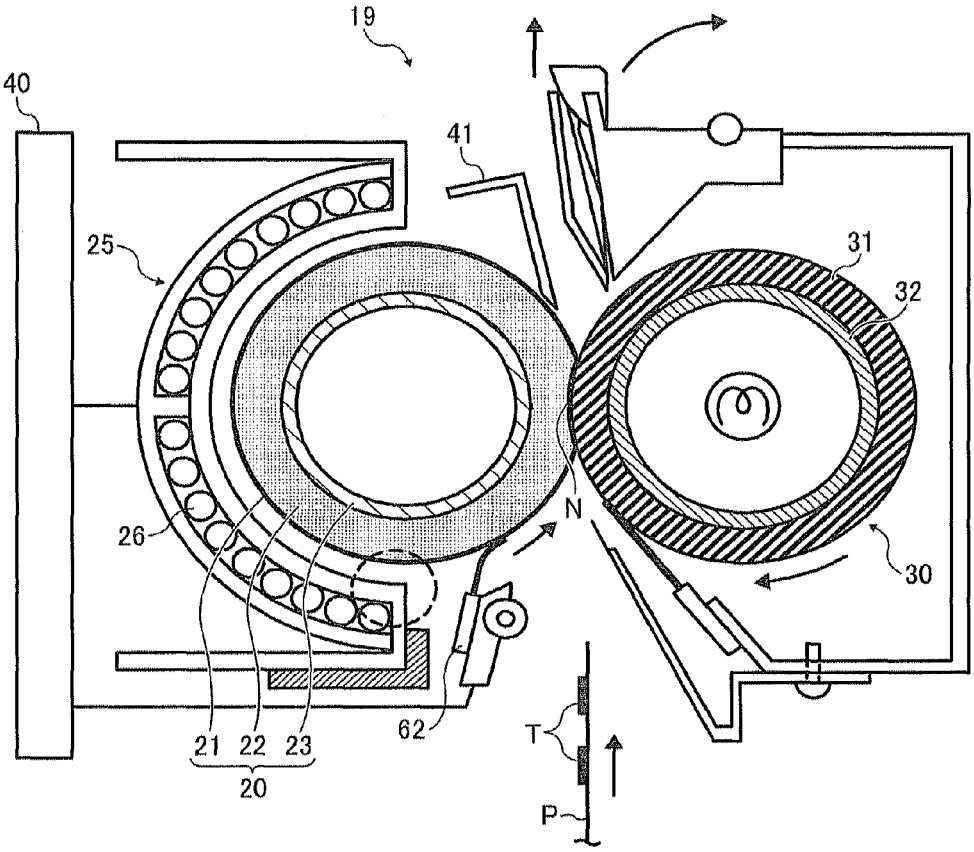
FIG. 2 is a vertical sectional view of a fixing device installed in the image forming apparatus shown in FIG. 1.

Referring to FIG. 2, the following describes the fixing device 19 installed in the image forming apparatus 1 described above.

FIG. 2 is a vertical sectional view of the fixing device 19. As illustrated in FIG. 2, the fixing device 19 (e.g., a fuser unit) includes a fixing roller 20; a pressing roller 30 pressed against the fixing roller 20 to form a fixing nip N therebetween; an induction heater 25 disposed opposite an outer circumferential surface of the fixing roller 20 to heat the fixing roller 20; a separator 41 disposed opposite the outer circumferential surface of the fixing roller 20 to separate a recording medium P discharged from the fixing nip N from the fixing roller 20; a temperature detector 62 disposed opposite the outer circumferential surface of the fixing roller 20 to detect a temperature of the fixing roller 20; and a controller 40 operatively connected to the induction heater 25 and the temperature detector 62. The controller 40, that is, a central processing unit (CPU) provided with a random-access memory (RAM) and a read-only memory (ROM), for example, controls the induction heater 25 based on the temperature of the fixing roller 20 detected by the temperature detector 62 so as to adjust the temperature of the outer circumferential surface of the fixing roller 20 to a predetermined fixing temperature.

The fixing roller 20 is constructed of a metal core 23, an elastic layer 22, made of sponge, disposed on the metal core 23, and a fixing sleeve 21 disposed on the elastic layer 22. The pressing roller 30 is constructed of a metal core 32 and an elastic layer 31, made of rubber, disposed on the metal core 32. The fixing roller 20 and the pressing roller 30 may be made of a foam material such as sponge and an elastic material such as rubber to attain desired pressure and nip length at the fixing nip N in the conveyance direction of the recording medium P. According to this example embodiment, the elastic layer 22 of the fixing roller 20 has a hardness of about 35 Hs; the elastic layer 31 of the pressing roller 30 has a hardness of about 60 Hs and a thickness of about 3 mm. Both the fixing roller 20 and the pressing roller 30 have an outer diameter of about 40 mm. Generally, the fixing sleeve 21 of the fixing roller 20 is constructed of a metal layer, having a thickness of about 15 micrometers, that generates heat, a silicone rubber layer having a thickness of about 200 micrometers, and a surface layer, having a thickness of about 30 micrometers, made of tetrafluoroethylene perfluoroalkylvinylether copolymer (PFA).

The fixing sleeve 21 is sandwiched by side guides shown in the broken line in FIG. 2 disposed in proximity to lateral edges of the fixing sleeve 21 in an axial direction of the fixing roller 20. If the fixing sleeve 21 is skewed, the skewed fixing sleeve 21 contacts the side guide that prohibits the fixing sleeve 21 from skewing farther. Alternatively, the fixing sleeve 21 may adhere to the elastic layer 22 to prevent potential skewing of the fixing sleeve 21.

The induction heater 25 that heats the fixing roller 20 by electromagnetic induction is disposed opposite the outer circumferential surface of the fixing roller 20 at a side opposite a fixing nip side of the fixing roller 20 disposed opposite the pressing roller 30 at the fixing nip N. For example, the induction heater 25 includes a coil assembly 26 that heats the fixing sleeve 21 partially. According to this example embodiment, a thermopile is used as the temperature detector 62 operatively connected to the controller 40. The controller 40 controls a power supply shown below to adjust an amount of power supplied to the induction heater 25 according to the temperature of the fixing roller 20 detected by the thermopile.

For example, the thermopile is composed of several thermocouples connected usually in series. The thermocouples are provided with a hot junction where infrared rays radiated from an object are collected. A cold junction is disposed at an inner position of the thermopile where temperature fluctuation barely arises. The thermocouples measure the temperature of the hot junction and the cold junction and generate an electromotive force according to the temperature differential between the temperature of the hot junction and the temperature of the cold junction. Thus, the thermopile serves as a time-responsive sensor. The thermopile includes an ambient sensor to address temperature fluctuation of the cold junction of the thermopile. According to this example embodiment, a single thermopile is used as the temperature detector 62. Alternatively, a plurality of temperature sensors may be used to detect the temperature of the fixing roller 20 at a plurality of positions thereon to correspond to various sizes of the recording medium P.

Figure 3:
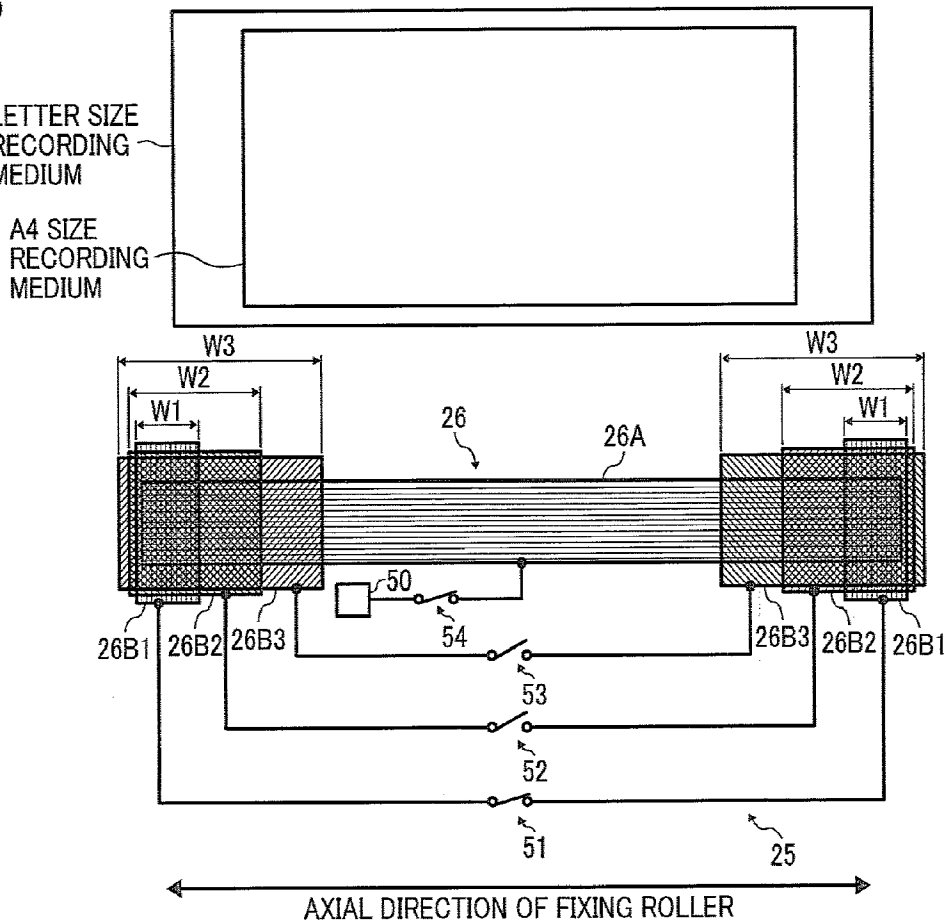
FIG. 3 is a horizontal sectional view of one example of a coil assembly incorporated in the fixing device shown in FIG. 2.

Referring to FIG. 3, the following describes the coil assembly 26 of the induction heater 25 incorporated in the fixing device 19 described above.

FIG. 3 is a horizontal sectional view of the coil assembly 26. As illustrated in FIG. 3, the coil assembly 26 includes an exciting coil 26A serving as a main coil and three pairs of degaussing coils serving as sub coils, that is, a first pair of degaussing coils 26B1, a second pair of degaussing coils 26B2, and a third pair of degaussing coils 26B3. The exciting coil 26A extends throughout the entire width of the coil assembly 26 corresponding to the axial length of the fixing roller 20 depicted in FIG. 2 and generates a magnetic flux throughout the entire width of the exciting coil 26A. Accordingly, when a small recording medium P is conveyed through the fixing nip N, lateral ends of the fixing roller 20 in the axial direction thereof heated by the magnetic flux generated by the exciting coil 26A are overheated because the small recording medium P does not pass over the lateral ends of the fixing roller 20 and therefore does not draw heat from the lateral ends of the fixing roller 20.

To address this problem, the first pair of degaussing coils 26B1, the second pair of degaussing coils 26B2, and the third pair of degaussing coils 26B3 are disposed at lateral ends of the coil assembly 26 corresponding to the lateral ends of the fixing roller 20 in the axial direction thereof. For example, the first pair of degaussing coils 26B1, the second pair of degaussing coils 26B2, and the third pair of degaussing coils 26B3 generate a repulsive magnetic flux that offsets a magnetic flux generated by the exciting coil 26A toward the fixing sleeve 21, preventing the lateral ends of the fixing roller 20 in the axial direction thereof from overheating while the small recording medium P is conveyed through the fixing nip N.

Specifically, the exciting coil 26A is connected to a power supply 50 via an exciting coil switch 54. The first pair of degaussing coils 26B1 is connected to a first degaussing coil switch 51. The second pair of degaussing coils 2682 is connected to a second degaussing coil switch 52. The third pair of degaussing coils 26B3 is connected to a third degaussing coil switch 53. The first degaussing coil switch 51, the second degaussing coil switch 52, the third degaussing coil switch 53, and the exciting coil switch 54 are operatively connected to the controller 40 depicted in FIG. 2. When the exciting coil 26A is connected to the power supply 50 via the exciting coil switch 54 in a state in which all of the first degaussing coil switch 51, the second degaussing coil switch 52, and the third degaussing coil switch 53 is open and therefore all of the first pair of degaussing coils 26B1, the second pair of degaussing coils 26B2, and the third pair of degaussing coils 26B3 is turned off, a magnetic flux generated by the exciting coil 26A penetrates the first pair of degaussing coils 26B1, the second pair of degaussing coils 26B2, and the third pair of degaussing coils 26B3 and reaches the fixing roller 20, thus heating the fixing roller 20 throughout the entire width thereof. Conversely, when one of the first degaussing coil switch 51, the second degaussing coil switch 52, and the third degaussing coil switch 53 is closed, one of the first pair of degaussing coils 26B1, the second pair of degaussing coils 26B2, and the third pair of degaussing coils 26B3 connected to the closed switch is turned on and generates a repulsive magnetic flux that offsets a magnetic flux generated by the exciting coil 26A, thus minimizing heat generation from lateral ends of the fixing roller 20 in the axial direction thereof disposed opposite the one of the first pair of degaussing coils 26B1, the second pair of degaussing coils 26B2, and the third pair of degaussing coils 26B3.

For example, in order to offset the magnetic flux according to various sizes of the recording medium P, the three pairs of degaussing coils, that is the first pair of degaussing coils 26B1, the second pair of degaussing coils 26B2, and the third pair of degaussing coils 26B3, are available in the fixing device 19. Each degaussing coil 26B1 of the first pair has a width W1 in the axial direction of the fixing roller 20; each degaussing coil 26B2 of the second pair has a width W2 greater than the width W1 in the axial direction of the fixing roller 20; each degaussing coil 26B3 of the third pair has a width W3 greater than the width W2 in the axial direction of the fixing roller 20.. When the controller 40 depicted in FIG. 2 identifies that a letter size recording medium P (215.9 mm×279.4 mm) is conveyed through the fixing nip N based on image data sent from the reader 4 depicted in FIG. 1 or information sent from a control panel 42 depicted in FIG. 1 with which a user inputs a print job, the controller 40 drives the first pair of degaussing coils 26B1 having the smallest width W1 via the first degaussing coil switch 51; when the controller 40 identifies that an A4 size recording medium P (210 mm×297 mm) is conveyed through the fixing nip N, the controller 40 drives the second pair of degaussing coils 26B2 having the medium width W2 via the second degaussing coil switch 52; when the controller 40 identifies that a B5 size recording medium P (182 mm×257 mm) is conveyed through the fixing nip N, the controller 40 drives the third pair of degaussing coils 26B3 having the greatest width W3 via the third degaussing coil switch 53. Thus, the controller 40 drives the three pairs of degaussing coils, that is, the first pair of degaussing coils 26B1, the second pair of degaussing coils 26B2, and the third pair of degaussing coils 26B3, independently.

In order to offset the magnetic flux according to the various sizes of the recording medium P more precisely, four or more pairs of degaussing coils having four or more widths in the axial direction of the fixing roller 20 may be incorporated in the fixing device 19. According to the example embodiment described above, the first pair of degaussing coils 26B1, the second pair of degaussing coils 26B2, and the third pair of degaussing coils 26B3 are disposed at the lateral ends of the coil assembly 26 in the axial direction of the fixing roller 20, respectively, because the recording medium P is conveyed over a center portion of the fixing sleeve 21 in the axial direction of the fixing roller 20. Alternatively, a first degaussing coil 26B1', a second degaussing coil 26B2', and a third degaussing coil 26B3' may be disposed at one lateral end of a coil assembly 26' in the axial direction of the fixing roller 20 as shown in FIG. 4.

Figure 4:
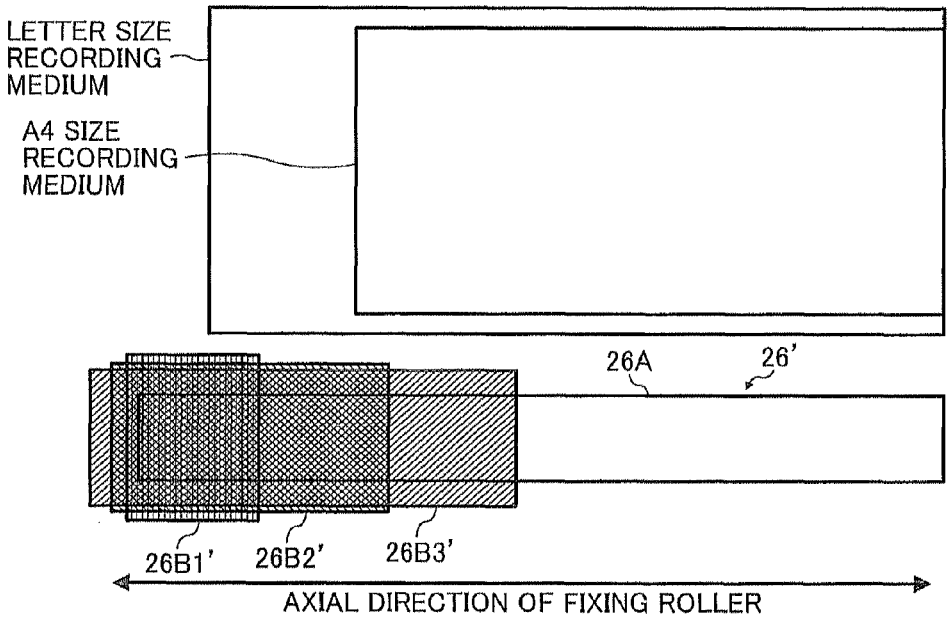
FIG. 4 is a horizontal sectional view of another example of the coil assembly incorporated in the fixing device shown in FIG. 2.

FIG. 4 is a horizontal sectional view of the coil assembly 26' with such arrangement of the first degaussing coil 26B1', the second degaussing coil 26B2', and the third degaussing coil 26B3'. For example, if the recording medium P is configured to be conveyed over the fixing sleeve 21 along one lateral edge of the fixing sleeve 21, the first degaussing coil 26B1', the second degaussing coil 26B2', and the third degaussing coil 26B3' may be disposed at one lateral end of the coil assembly 26' through which the recording medium P is not conveyed. Like the arrangement shown in FIG. 3, the first degaussing coil 26B1', the second degaussing coil 26B2', and the third degaussing coil 26B3' have different widths in the axial direction of the fixing roller 20 that correspond to various non-conveyance regions of the fixing roller 20 through which recording media P of various sizes are not conveyed.

Referring to FIGS. 1 and 2, the following describes the operation of the image forming apparatus 1 installed with the fixing device 19 having the above-described configuration.

As the photoconductors 11Y, 11M, 11C, and 11K rotate in the rotation direction R1, the chargers 12Y, 12M, 12C, and 12K uniformly charge the outer circumferential surface of the respective photoconductors 11Y, 11M, 11C, and 11K. Then, the optical writer 2 emits laser beams onto the charged outer circumferential surface of the respective photoconductors 11Y, 11M, 11C, and 11K according to image data sent from the reader 4, thus forming an electrostatic latent image on the outer circumferential surface of the respective photoconductors 11Y, 11M, 11C, and 11K. Thereafter, the development devices 13Y, 13M, 13C, and 13K supply yellow, magenta, cyan, and black toners to the electrostatic latent images on the photoconductors 11Y, 11M, 11C, and 11K, thus visualizing the electrostatic latent images as yellow, magenta, cyan, and black toner images, respectively.

As the driver rotates the driving roller over which the intermediate transfer belt 17 is looped, the driving roller rotates the intermediate transfer belt 17 in the rotation direction R2 which in turn rotates the driven rollers, such as the primary transfer rollers 3Y, 3M, 3C, and 3K and the secondary transfer roller 6. As the intermediate transfer belt 17 rotates in the rotation direction R2, the primary transfer rollers 3Y, 3M, 3C, and 3K transfer the yellow, magenta, cyan, and black toner images formed on the photoconductors 11Y, 11M, 11C, and 11K onto the intermediate transfer belt 17 successively in such a manner that the yellow, magenta, cyan, and black toner images are superimposed on the same position on the intermediate transfer belt 17, thus forming a color toner image on the intermediate transfer belt 17. After the transfer of the yellow, magenta, cyan, and black toner images from the photoconductors 11Y, 11M, 11C, and 11K, the cleaners 15Y, 15M, 15C, and 15K remove residual toner not transferred onto the intermediate transfer belt 17 and therefore remaining on the photoconductors 11Y, 11M, 11C, and 11K therefrom, respectively. Thus, the photoconductors 11Y, 11M, 11C, and 11K become ready for the next image forming processes performed thereon.

The feed roller 8 picks up and feeds an uppermost recording medium P from a plurality of recording media P loaded on the paper tray 7 to the registration roller pair 14. When the uppermost recording medium P reaches the registration roller pair 14, it stops the recording medium P temporarily. Then, the registration roller pair 14 resume rotating to feed the recording medium P to the secondary transfer nip formed between the secondary transfer opposed roller 18 and the intermediate transfer belt 17 at a time when the color toner image formed on the intermediate transfer belt 17 is transferred onto the recording medium P. As the recording medium P is conveyed through the secondary transfer nip, the secondary transfer roller 6 transfers the color toner image formed on the intermediate transfer belt 17 onto the recording medium P.

Thereafter, the recording medium P bearing the color toner image is conveyed to the fixing device 19. As shown in FIG. 2, as the recording medium P is conveyed through the fixing nip N formed between the fixing roller 20 and the pressing roller 30, the fixing roller 20 and the pressing roller 30 apply heat and pressure to the recording medium P, thus melting and fixing a toner image T on the recording medium P. The recording medium P bearing the fixed toner image T is discharged from the fixing nip N as the separator 41 separates the recording medium P from the fixing roller 20. Then, the output roller pair 9 discharges the recording medium P onto the outside of the image forming apparatus 1. After the transfer of the color toner image from the intermediate transfer belt 17, the belt cleaner 16 removes residual toner not transferred from the intermediate transfer belt 17 and therefore remaining on the intermediate transfer belt 17 therefrom. Thus, the intermediate transfer belt 17 becomes ready for the next image forming processes performed thereon.

With the above-described configuration of the fixing device 19, the controller 40 powers on and off the induction heater 25 according to the temperature of the fixing roller 20 detected by the temperature detector 62, thus adjusting the temperature of the fixing roller 20 to a desired fixing temperature.

With the fixing device 19 in which the induction heater 25 heats the fixing roller 20 at a part of the fixing roller 20 with a smaller thermal capacity and a smaller thermal conduction, as soon as power is supplied to the induction heater 25, the temperature of the fixing roller 20 increases quickly. Conversely, as soon as power supply to the induction heater 25 is stopped, the temperature of the fixing roller 20 decreases quickly. For example, as shown in FIG. 3, a switching element is used as the first degaussing coil switch 51, the second degaussing coil switch 52, and the third degaussing coil switch 53 to turn on and off the first pair of degaussing coils 26B1, the second pair of degaussing coils 26B2, and the third pair of degaussing coils 26B3. With this configuration, it is necessary to turn off the exciting coil 26A while switching between the first pair of degaussing coils 26B1, the second pair of degaussing coils 26B2, and the third pair of degaussing coils 26B3. Otherwise, serially-connected relays used to turn on and off the first pair of degaussing coils 26B1, the second pair of degaussing coils 26B2, and the third pair of degaussing coils 26B3 may be short-circuited and melted. However, if the exciting coil 26A is turned off while switching between the first pair of degaussing coils 26B1, the second pair of degaussing coils 26B2, and the third pair of degaussing coils 26B3, a part of the fixing roller 20 may not be heated by the exciting coil 26A, resulting in variation in the temperature of the fixing roller 20 in a circumferential direction, that is, a direction of rotation of the fixing roller 20 that rotates counterclockwise in FIG. 2, thus causing so-called temperature ripple of the fixing roller 20.

To address this problem, a proportional-integral-derivative controller (PID controller) may be employed to calculate power used for the next temperature control cycle by measuring the present temperature of the fixing roller 20. The PID controller has an advantage of maintaining the temperature of the fixing roller 20 at a predetermined temperature in the long view, but has a disadvantage of a slow thermal response in detecting temperature variation of the fixing roller 20 in the circumferential direction thereof and power decrease due to switching between the first pair of degaussing coils 26B1, the second pair of degaussing coils 26B2, and the third pair of degaussing coils 26B3 so as to adjust the temperature of the fixing roller 20. Accordingly, the PID controller cannot eliminate temperature ripple of the fixing roller 20 completely.

For example, there is a time lag after the temperature detector 62 detects the temperature of the fixing roller 20. That is, the controller 40 does not adjust an amount of magnetic flux generated by the induction heater 25 at the same time when the temperature detector 62 detects the temperature of the fixing roller 20. Accordingly, it is difficult to complement an amount of power decreased during switching between the first pair of degaussing coils 26B1, the second pair of degaussing coils 26B2, and the third pair of degaussing coils 26B3, resulting in temperature ripple of the fixing roller 20. To address this circumstance, there is a need for an improved control method for adjusting the amount of power supplied to the coil assembly 26 earlier than a conventional control method for adjusting the amount of power supplied to the coil assembly 26 after the controller 40 identifies the temperature of the fixing roller 20 detected by the temperature detector 62.

Figure 5:
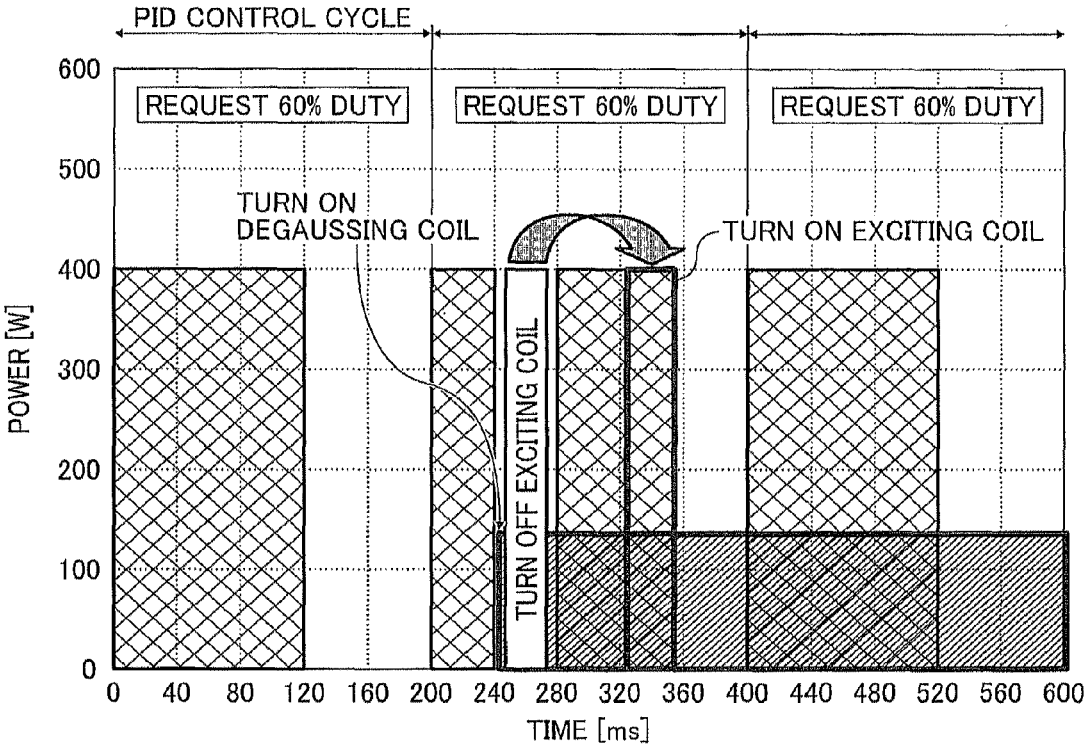
FIG. 5 is a graph showing a relation between time and power supplied to the coil assembly shown in FIG. 3.

Referring to FIG. 5, a description is now given of the improved control method for adjusting the amount of power supplied to the coil assembly 26.

FIG. 5 is a graph showing a relation between time and power supplied to the coil assembly 26. In FIG. 5, the grid pattern area shows power supplied to the exciting coil 26A and a time period for power supply; the diagonally shaded area shows power supplied to one of the first pair of degaussing coils 26B1, the second pair of degaussing coils 26B2, and the third pair of degaussing coils 26B3 and a time period for power supply. As shown in FIG. 5, power not supplied to the exciting coil 26A to turn off the exciting coil 26A during switching between the first pair of degaussing coils 26B1, the second pair of degaussing coils 26B2, and the third pair of degaussing coils 26B3 is added to power supplied to the exciting coil 26A to turn on the exciting coil 26A the next time. Accordingly, the exciting coil 26A is turned on for an extra time period corresponding to the supplied power. Thus, power not supplied to the exciting coil 26A while it is turned off is consumed in the same PID control cycle in which power is not used during switching between the first pair of degaussing coils 26B1, the second pair of degaussing coils 26B2, and the third pair of degaussing coils 26B3, that is, turning on one of the first pair of degaussing coils 26B1, the second pair of degaussing coils 26B2, and the third pair of degaussing coils 26B3 and at the same time turning off the others. Accordingly, reserved power is used to turn on the exciting coil 26A the next time. Consequently, temperature ripple of the fixing roller 20 caused by interruption of power supply to the exciting coil 26A to turn off the exciting coil 26A during switching between the first pair of degaussing coils 26B1, the second pair of degaussing coils 26B2, and the third pair of degaussing coils 26B3 is minimized.

If the exciting coil 26A is driven in a pulse width modulation (PWM), duty is increased by a time when the exciting coil 26A is turned off during switching between the first pair of degaussing coils 26B1, the second pair of degaussing coils 26B2, and the third pair of degaussing coils 26B3. By contrast, if the exciting coil 26A is driven by a pulse amplitude modulation (PAM), an amount of power requested by a PID operation that is multiplied by an amount of power not supplied to the exciting coil 26A during switching between the first pair of degaussing coils 26B1, the second pair of degaussing coils 26B2, and the third pair of degaussing coils 26B3 is added to an amount of power used to turn on the exciting coil 26A the next time.

Referring to FIGS. 1, 2, 3, and 6, a description is now given of a first example of the improved control method for heating the fixing roller 20 as described above.

Figure 6:
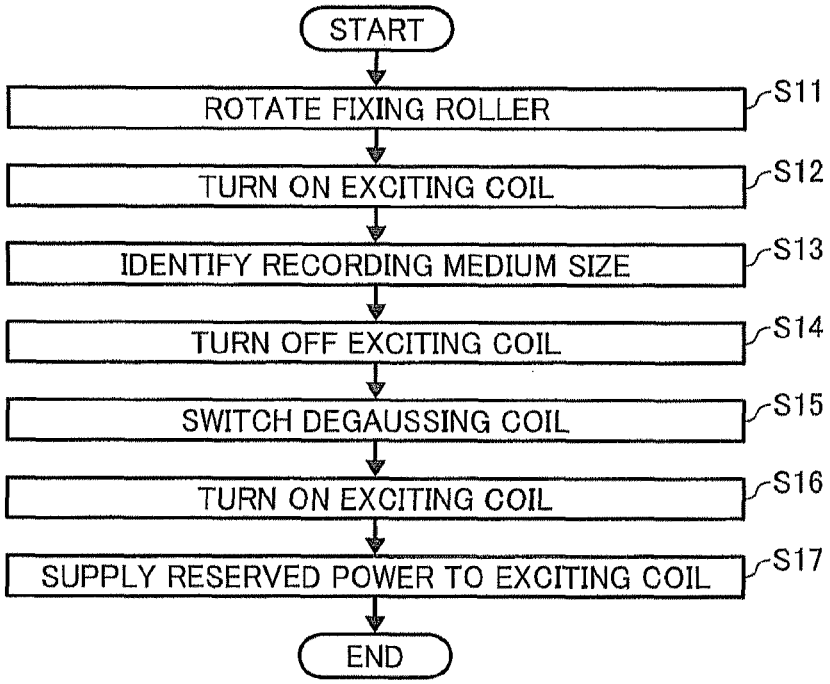
FIG. 6 is a flowchart showing one example of a control method employed by the fixing device shown in FIG. 2.

FIG. 6 is a flowchart showing steps of the first example of the improved control method. In step S11, the fixing roller 20 rotates counterclockwise in FIG. 2. In step S12, the controller 40 turns on the exciting coil switch 54 to connect the power supply 50 to the exciting coil 26A, thus turning on the exciting coil 26A. In step S13, the controller 40 identifies the size of a recording medium P to be conveyed to the fixing roller 20 according to image data sent from the reader 4 or information sent from the control panel 42. In step S14, the controller 40 turns off the exciting coil switch 54 to disconnect the power supply 50 from the exciting coil 26A, thus turning off the exciting coil 26A. Simultaneously, in step S15, the controller 40 switches between the first pair of degaussing coils 26B1, the second pair of degaussing coils 26B2, and the third pair of degaussing coils 26B3 to turn on one of them corresponding to the size of the recording medium P identified in step S13. In step S16, after switching is finished, the controller 40 turns on the exciting coil switch 54 to connect the power supply 50 to the exciting coil 26A, thus turning on the exciting coil 26A. In step S17, the controller 40 retains the exciting coil switch 54 on to supply reserved power not supplied to the exciting coil 26A while the exciting coil 26A is turned off in step S14 to the exciting coil 26A, thus turning on the exciting coil 26A for an extra time period corresponding to the supplied power.

With a configuration of the fixing device 19 in which the induction heater 25 heats a part of the fixing roller 20 at a heating position where the induction heater 25 is disposed opposite the fixing roller 20 in a state in which heat is barely conducted in the circumferential direction of the fixing roller 20, power not supplied to the exciting coil 26A during switching between the first pair of degaussing coils 26B1, the second pair of degaussing coils 26B2, and the third pair of degaussing coils 26B3 may be added to power used to turn on the exciting coil 26A the next time after the heated part of the fixing roller 20 rotates and returns to the heating position where the induction heater 25 heats the fixing roller 20. By doing so, a part of the fixing roller 20 that is not heated by the induction heater 25 while the exciting coil 26A is turned off during switching between the first pair of degaussing coils 26B1, the second pair of degaussing coils 26B2, and the third pair of degaussing coils 26B3 is heated when that part of the fixing roller 20 rotates counterclockwise in FIG. 2 by about 360 degrees. Accordingly, variation in the temperature of the fixing roller 20 is minimized in the circumferential direction thereof, reducing temperature ripple of the fixing roller 20.

Referring to FIGS. 1, 2, 3, and 7, a description is now given of a second example of the improved control method for heating the fixing roller 20 as described above.

Figure 7:
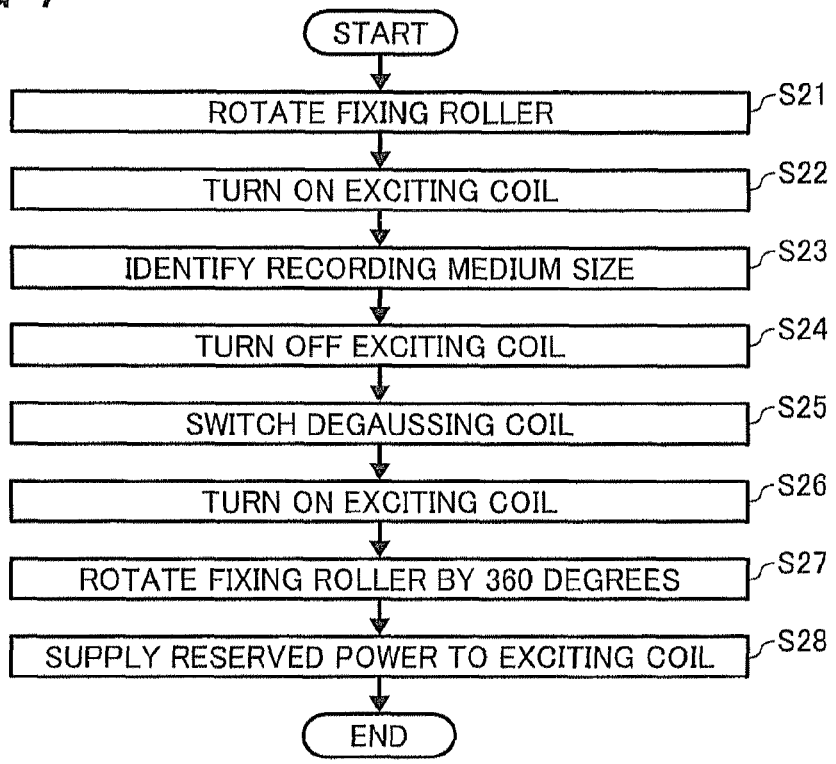
FIG. 7 is a flowchart showing another example of a control method employed by the fixing device shown in FIG. 2.

FIG. 7 is a flowchart showing steps of the second example of the improved control method. In step S21, the fixing roller 20 rotates counterclockwise in FIG. 2. In step S22, the controller 40 turns on the exciting coil switch 54 to connect the power supply 50 to the exciting coil 26A, thus turning on the exciting coil 26A. In step S23, the controller 40 identifies the size of a recording medium P to be conveyed to the fixing roller 20 according to image data sent from the reader 4 or information sent from the control panel 42. In step S24, the controller 40 turns off the exciting coil switch 54 to disconnect the power supply 50 from the exciting coil 26A, thus turning off the exciting coil 26A. Simultaneously, in step S25, the controller 40 switches between the first pair of degaussing coils 26B1, the second pair of degaussing coils 26B2, and the third pair of degaussing coils 26B3 to turn on one of them corresponding to the size of the recording medium P identified in step S23. In step S26, after switching is finished, the controller 40 turns on the exciting coil switch 54 to connect the power supply 50 to the exciting coil 26A, thus turning on the exciting coil 26A. In step S27, the fixing roller 20 rotates counterclockwise in FIG. 2 by about 360 degrees. When a non-heated part of the fixing roller 20 not heated by the exciting coil 26A while the exciting coil 26A is turned off in step S24 returns to the heating position where the exciting coil 26A is disposed opposite the non-heated part of the fixing roller 20, the controller 40 retains the exciting coil switch 54 on to supply reserved power not supplied to the exciting coil 26A while the exciting coil 26A is turned off in step S24 to the exciting coil 26A, thus turning on the exciting coil 26A for an extra time period corresponding to the supplied power in step S28.

With the first and second examples of the improved control method described above, the fixing device 19 completes the fixing process of fixing the toner image T on the recording medium P precisely with minimized energy. It is to be noted that the first and second examples of the improved control method described above are also applicable to the configuration of the coil assembly 26' shown in FIG. 4.

Referring to FIGS. 2 to 4, the following describes advantages of the fixing device 19 according to the example embodiments described above.

The fixing device 19 includes the induction heater 25 disposed opposite the fixing roller 20 serving as a fixing rotary body. The induction heater 25 includes the exciting coil 26A that generates a magnetic flux toward the fixing roller 20 to heat the fixing roller 20 and the first pair of degaussing coils 26B1, the second pair of degaussing coils 26B2, and the third pair of degaussing coils 26B3 disposed between the exciting coil 26A and the fixing roller 20 to generate a repulsive magnetic flux that offsets the magnetic flux generated by the exciting coil 26A toward the fixing roller 20. The controller 40 operatively connected to the induction heater 25 turns on and off the exciting coil 26A, the first pair of degaussing coils 26B1, the second pair of degaussing coils 26B2, and the third pair of degaussing coils 26B3. Within a control cycle that turns on one of the first pair of degaussing coils 26B1, the second pair of degaussing coils 26B2, and the third pair of degaussing coils 26B3, the controller 40 turns off the exciting coil 26A while the one of the first pair of degaussing coils 26B1, the second pair of degaussing coils 26B2, and the third pair of degaussing coils 26B3 is switched to other one thereof. The controller 40 adds power not supplied to the exciting coil 26A and therefore reserved during switching between the first pair of degaussing coils 26B1, the second pair of degaussing coils 26B2, and the third pair of degaussing coils 26B3 to power used to turn on the exciting coil 26A the next time, thus turning on the exciting coil 26A for an extra time period corresponding to the reserved power. As a result, temperature ripple, that is, temperature variation, of the fixing roller 20 in the circumferential direction thereof is minimized.

The fixing rotary body may be the fixing roller 20 or an endless belt that rotates in a predetermined direction of rotation. The induction heater 25 heats the rotating fixing rotary body at a heating position where the induction heater 25 is disposed opposite the fixing rotary body. Accordingly, while the controller 40 turns off the exciting coil 26A during switching between the first pair of degaussing coils 26B1, the second pair of degaussing coils 26B2, and the third pair of degaussing coils 26B3, a part of the fixing rotary body in the circumferential direction thereof is not heated by the exciting coil 26A. To address this circumstance, when that part of the fixing rotary body rotates and returns to the heating position where the induction heater 25 is disposed opposite and heats the fixing rotary body, the controller 40 adds power not supplied to the exciting coil 26A while it is turned off to power used to turn on the exciting coil 26A the next time, thus minimizing temperature ripple of the fixing rotary body more effectively.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body rotatable in a predetermined direction of rotation;

an induction heater disposed opposite the fixing rotary body to heat the fixing rotary body; and a controller operatively connected to the induction heater, the induction heater including:

an exciting coil to generate a magnetic flux toward the fixing rotary body;

a first pair of degaussing coils disposed opposite lateral ends of the exciting coil in an axial direction of the fixing rotary body to offset the magnetic flux generated by the exciting coil, each degaussing coil of the first pair having a first width in the axial direction of the fixing rotary body;

a second pair of degaussing coils disposed opposite the lateral ends of the exciting coil in the axial direction of the fixing rotary body to offset the magnetic flux generated by the exciting coil, each degaussing coil of the second pair having a second width in the axial direction of the fixing rotary body greater than the first width of each degaussing coil of the first pair;

an exciting coil switch connected to the exciting coil and a power supply to connect and disconnect the exciting coil to and from the power supply to turn on and off the exciting coil;

a first degaussing coil switch connected to the first pair of degaussing coils to turn on and off the first pair of degaussing coils; and a second degaussing coil switch connected to the second pair of degaussing coils to turn on and off the second pair of degaussing coils, wherein the controller causes the exciting coil switch to turn off the exciting coil for a given time after the controller starts turning on one of the first degaussing coil switch and the second degaussing coil switch and at the same time turns off the other one of the first degaussing coil switch and the second degaussing coil switch, and then causes the exciting coil switch to turn on the exciting coil for an extra time period corresponding to the given time when the exciting coil is turned off.

2. The fixing device according to claim 1, wherein the controller causes the exciting coil switch to turn on the exciting coil for the extra time period at a time when a section of the fixing rotary body that passes through the induction heater while the exciting coil is turned off returns to a position disposed opposite the induction heater.

3. The fixing device according to claim 1, wherein the first width of each degaussing coil of the first pair corresponds to a non-heating region of the fixing rotary body through which a greater recording medium is not conveyed and the second width of each degaussing coil of the second pair corresponds to a non-heating region of the fixing rotary body through which a smaller recording medium is not conveyed, and wherein the controller turns on one of the first pair of degaussing coils and the second pair of degaussing coils according to a size of a recording medium conveyed to the fixing rotary body.

4. The fixing device according to claim 1, wherein the fixing rotary body includes one of a roller and an endless belt.

5. An image forming apparatus comprising the fixing device according to claim 1.

6. A fixing device comprising:

a fixing rotary body rotatable in a predetermined direction of rotation;

an induction heater disposed opposite the fixing rotary body to heat the fixing rotary body; and a controller operatively connected to the induction heater, the induction heater including:

an exciting coil to generate a magnetic flux toward the fixing rotary body;

a first degaussing coil disposed opposite one lateral end of the exciting coil in an axial direction of the fixing rotary body to offset the magnetic flux generated by the exciting coil and having a width in the axial direction of the fixing rotary body;

a second degaussing coil disposed opposite the one lateral end of the exciting coil in the axial direction of the fixing rotary body to offset the magnetic flux generated by the exciting coil and having a width in the axial direction of the fixing rotary body greater than the width of the first degaussing coil;

an exciting coil switch connected to the exciting coil and a power supply to connect and disconnect the exciting coil to and from the power supply to turn on and off the exciting coil;

a first degaussing coil switch connected to the first degaussing coil to turn on and off the first degaussing coil; and a second degaussing coil switch connected to the second degaussing coil to turn on and off the second degaussing coil, wherein the controller causes the exciting coil switch to turn off the exciting coil for a given time after the controller starts turning on one of the first degaussing coil switch and the second degaussing coil switch and at the same time turns off the other one of the first degaussing coil switch and the second degaussing coil switch, and then causes the exciting coil switch to turn on the exciting coil for an extra time period corresponding to the given time when the exciting coil is turned off.

7. A method for heating a fixing rotary body with an induction heater including an exciting coil and a plurality of degaussing coils, the method comprising:

rotating the fixing rotary body;

turning on the exciting coil;

identifying a size of a recording medium to be conveyed to the fixing rotary body;

turning off the exciting coil;

turning on one of the plurality of degaussing coils and turning off the other one of the plurality of degaussing coils according to the identified size of the recording medium;

turning on the exciting coil; and supplying reserved power not supplied to the exciting coil while the exciting coil is turned off to the exciting coil to turn on the exciting coil for an extra time period corresponding to the supplied power, wherein a controller causes the exciting coil switch to turn off the exciting coil for a given time after the controller starts turning on one of a plurality of degaussing coil switch and another one of a plurality of degaussing coil switch and at the same time turns off the other one of the degaussing coil switch and the another degaussing coil switch, and then causes the exciting coil switch to turn on the exciting coil for an extra time period corresponding to the given time when the exciting coil is turned off.

8. The method according to claim 7, further comprising a step of rotating the fixing rotary body by about 360 degrees before supplying the reserved power to the exciting coil.

* * * * *